US005637030A

United States Patent [19]

Chopra et al.

[11] Patent Number: 5,637,030

[45] Date of Patent: Jun. 10, 1997

[54] ABRASIVE FORMULATION FOR WATERJET CUTTING AND METHOD EMPLOYING SAME

[75] Inventors: Manjit S. Chopra, Tucson, Ariz.; Stephen F. Mehlman, Van Nuys, Calif.

[73] Assignee: Minerals Research & Recovery, Inc., Tucson, Ariz.

[21] Appl. No.: 198,119

[22] Filed: Feb. 17, 1994

[51] Int. Cl.[6] ..... B24C 11/00

[52] U.S. Cl. ..... 451/39; 51/309

[58] Field of Search ..... 451/38, 39, 40; 51/293, 309

[56] References Cited

U.S. PATENT DOCUMENTS

| | | | |
|---|---|---|---|
| 3,939,613 | 2/1976 | Ayers | 451/39 |
| 4,035,962 | 7/1977 | Ayers | 451/39 |
| 5,363,603 | 11/1994 | Miller et al. | 451/40 |
| 5,456,628 | 10/1995 | Csabai | 451/36 |

FOREIGN PATENT DOCUMENTS

| | | |
|---|---|---|
| 2132220 | 5/1995 | Canada . |
| 0018152 | 10/1980 | European Pat. Off. . |

OTHER PUBLICATIONS

Singh, P., "Abrasive Fluid Jet Machining", *Engineered Materials Handbook*, vol. 4, pp. 363–366 (Jan. 1991).

Hashish, M., "Abrasive Jets", *Fluid Jet Technology Fundamentals and Applications*, pp. 49–100 (Jan. 1991).

*Primary Examiner*—Robert A. Rose

*Attorney, Agent, or Firm*—Shook, Hardy & Bacon L.L.P.

[57] ABSTRACT

An abrasives formulation is provided for abrasive waterjet processes. The abrasives include a first particulate component which is a high-density, high-hardness crystalline material such as specular hematite. A second particulate component can optionally be combined with the first component and is a medium-density, medium-hardness cryptocrystalline material such as copper slag. An optional third particulate component is any of various ultra-hard materials such as aluminum oxide, boron carbide or silicon carbide. The first component can be used for cutting glass, stone and other brittle materials. The first and second components in combination are used for cutting ductile materials, with the third component being added when hard and/thick metals or ceramics are to be cut. Particles sizes are typically within the range of No. 20 to No. 220 U.S. Standard Sieve.

18 Claims, 1 Drawing Sheet

ABRASIVE FORMULATION FOR WATERJET CUTTING AND METHOD EMPLOYING SAME

BACKGROUND OF THE INVENTION

This invention relates in general to abrasives and, more particularly, to abrasives used in waterjet cutting processes.

Abrasives have been used in conventional abrasive air-jet and abrasive waterjet processes for a variety of machining and cutting applications. In abrasive air-jet processes, abrasive particles are entrained in air and are propelled through a nozzle at speeds which may be supersonic. The abrasive laden air-jet is then directed onto a substrate where the impact and shearing action of the abrasive particles causes removal of the intended surface material. While abrasive air-jets are well suited for sandblasting and deburring operations, they are impractical for precision machining because of the difficulty in controlling both the air-jet structure at supersonic speeds and the particle distribution within the jet.

In abrasive waterjet cutting, the abrasives are mixed with water or another liquid rather than air. The waterjet can generally transport greater quantities of abrasive particles and can be confined to a smaller diameter in comparison to air-jets. As a result, abrasive waterjets are capable of developing much higher energy than air-jets and can easily cut through most materials. The ability to focus and control the waterjet allows it to be used in precision machining operations to cut or otherwise machine materials, including metals such as aluminum, steel, titanium and high-nickel alloys, brittle materials such as glass, granite and marble, green and reinforced composite materials, honeycomb and sandwiched materials, and certain ceramics. Abrasive waterjets are also particularly well adapted for the shape cutting of sheets, plates and castings of these materials.

The nozzle which is used in conventional abrasive waterjet systems has a sapphire or diamond orifice which forms the high-velocity waterjet. The vacuum created by the waterjet draws abrasives into a mixing chamber which is within the nozzle and is downstream from the orifice. The abrasives then mix with the waterjet and, as a result of the transfer of momentum from the liquid, are rapidly accelerated to speeds which can be several times the speed of sound. The waterjet and entrained abrasives leave the mixing chamber and travel along an ultrahard tungsten-carbide tube which is aligned concentrically with the orifice. A focused, high-velocity stream of abrasive then exits the nozzle to perform the desired machining of the target material.

The use of abrasive waterjets to cut target materials causes little if any thermal distortion or oxidation or structural change to the cut surface. This type of cutting process thus offers significant advantages over conventional plasma or arc cutting methods. In addition, the cutting process is omnidirectional and complex contours can be easily cut in a continuous operation. Generation of airborne dust is also virtually eliminated in abrasive waterjet cutting processes. As a result, the process can be environmentally less hazardous than conventional processes which generate dust during the cutting operation.

Despite the many advantages of abrasive waterjet machining processes, the operating costs for such processes make them unsuited for many applications. Because the abrasives used in such processes contribute substantially to the operational costs, much attention has been focused on developing less costly abrasives.

Abrasives which have been used in conventional abrasive waterjet systems generally include garnet, silica sand, glass cullet, copper slag, steel shot, and olivine. Abrasives are generally selected by their material, size and shape. For example, it is generally known that waterjet cutting effectiveness increases with higher hardness of the abrasive particles relative to the hardness of the material being cut, with the relative hardness of the abrasive material having a more significant effect for hard target metals than for softer metals.

The use of ultra-hard abrasives such as aluminum oxide and silicon carbide have been attempted but they have been found to be generally impractical for use because they cause rapid abrasion of the nozzle mixing tube. Even when the mixing tube is formed from ultrahard carbide composites, the useful life of the tube can be reduced to a matter of minutes when aluminum oxide or silicon carbide is used as the abrasive.

As a result of the difficulties encountered in attempting to use ultra-hard abrasives, a less hard material such as garnet must generally be used as a waterjet abrasive to cut metals and other hard, brittle or ductile materials. Garnet has a generally acceptable hardness relative to the target metals and causes less wear on the nozzle mixing tube in comparison to aluminum oxide and silicon carbide. The use of garnet, however, adds significantly to the cost of the waterjet process because it is a relatively rare mineral and is costly to produce in a purified form.

A significant need has thus developed for a waterjet abrasive that has a cutting efficiency comparable to garnet but is less costly so that waterjet machining processes can be used more economically and for a wider range of applications.

SUMMARY OF THE INVENTION

It is an object of this invention to provide waterjet abrasives that are capable of efficiently machining target materials and can be economically produced so that the abrasive waterjet machining process can be performed at a cost which allows for a wider range of uses.

It is another object of this invention to provide a waterjet abrasive which is specifically engineered for particular applications so that efficient machining of the target material can be accomplished.

It is also an object of this invention to provide a waterjet abrasive which is soft enough so that the mixing tube of the waterjet nozzle does not need to be formed from an ultrahard and expensive carbide composite material, thereby allowing less expensive materials to be used for the mixing tube while still providing for an acceptable wear resistance for the nozzle.

To accomplish these and other related objects, in one aspect the invention is directed to an abrasives formulation sized for mixing with a fluid to form an abrasive waterjet used to cut target materials, said abrasives formulation having a first component comprising particles of a crystalline material having a specific gravity of between approximately 4.5 and 6 with substantially all of the particles being sized to pass through a No. 20 U.S. Standard Sieve mesh screen and be retained on a No. 220 U.S. Standard Sieve screen.

In another aspect, the invention is directed to an abrasives formulation comprising:

a first component comprising particles of a crystalline material having a specific gravity of between approximately 4.5 and 6 and a Vickers or Knoop harness of greater than approximately 900; and a second component comprising particles of a cryptocrystalline material selected from the group consisting of cryptocrystalline copper slag, fayalite and olivine, said particles of the first and second component being sized so that substantially all of the particles will pass through a No. 20 U.S. Standard Sieve mesh screen and be retained on a No. 220 U.S. Standard Sieve screen.

Preferred materials include specular hematite as the first component and cryptocrystalline copper slag as the second component. A third component can optionally be added to the abrasives formulation and comprises particles of an ultra-hard material selected from the group consisting of one or more of diamond, topaz, sapphire, ruby, aluminum oxide, corundum, staurolite, silicon carbide, boron carbide and emery. A preferred formulation comprises 25 to 70% by weight specular hematite particles; 15 to 55% by weight cryptocrystalline copper slag particles; and 10 to 40% by weight of the third component, typically aluminum oxide.

In a further aspect, the invention is directed to a method of using the abrasives formulations to cut or otherwise machine a target material, said method comprising the steps of generating a waterjet comprising a liquid and entrained abrasives particles as described above; and directing said waterjet against the target material to remove portions thereof.

BRIEF DESCRIPTION OF THE DRAWINGS

In the accompanying drawings which form a part of the specification and are to be read in conjunction therewith and in which like reference numerals are used to indicate like parts in the various views.

DESCRIPTION OF THE PREFERRED EMBODIMENTS

Figure 1:
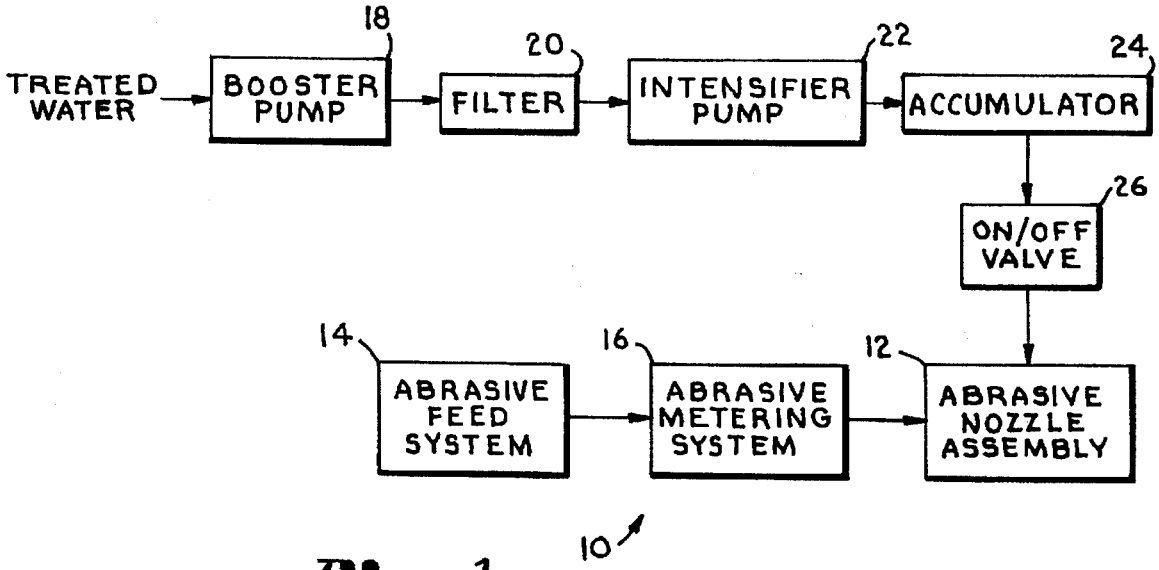
FIG. 1 is a schematic illustration of an abrasive waterjet apparatus which can be used in a method in accordance with the present invention.

The abrasives of the present invention include a first component comprising particles of a high-density, high-hardness crystalline material, a second optional component comprising particles of a medium-density, medium-hardness cryptocrystalline material and a third optional component comprising particles of ultra-hard materials.

It has been determined that the high-density of the crystalline first component significantly contributes to the ability of the abrasive particles to efficiently remove portions of a target material. The discovery of the significance of the particle density rather than just the particle hardness in achieving removal of target material has lead to the identification of many suitable abrasive materials which might otherwise have been thought to be unsuited for use as waterjet abrasives because they lacked the desired hardness.

The first component of the abrasives can be a naturally occurring mineral or a synthetic material. The first component preferably has a specific gravity of between approximately 4.5 and 6 and a Vickers or Knoop hardness greater than 900. Vickers and Knoop hardness values are measures of the resistance of the material to indentation by diamond. Desirably, the first component also has a cubical shape which is retained as the material breaks into smaller pieces during formation and travel in the waterjet and during impact against the target material. As used herein, the term "cubical shape" describes a geometric form having multiple faces and sharp rather than rounded edges. Crystalline materials generally provide the desired cubical shape.

Examples of generally suitable materials can include one or more minerals selected from the group consisting of specular hematite, magnetite, zircon, rutile, cassiterite, ilmenite, pyrite, and chromite. Of these minerals, hematite, magnetite, zircon and rutile are preferred. Hematite is the most preferred first component because of its comparatively low cost and the discovery of its suitability for efficiently cutting many types of target materials. As used herein, cutting efficiency is defined as the depth of the kerf created during cutting per unit weight of abrasive. The chemical formula and specific gravity for these minerals are set forth in the following table:

| Material (formula) | Specific Gravity |
|---|---|
| hematite ($Fe_2O_3$) | 5.25 |
| magnetite ($Fe_3O_4$) | 5.18 |
| zircon ($ZrSiO_4$) | 4.6–4.7 |
| rutile ($TiO_2$) | 4.3–5.5 |
| cassiterite ($SnO_2$) | 6.99 |
| ilmenite ($FeTiO_2$) | 4.68–4.76 |
| pyrite ($FeS_2$) | 5.02 |
| chromite ($FeCr_2O_4$) | 4.5–5.1 |

It is believed that the enhanced cutting action achieved by the first component of the abrasives is due in part to the increased momentum experienced by these heavy particles. This increased momentum results in removal of greater quantities of ductile material and enhances the initiation and propagation of cracks in brittle materials. The first component is thus particularly well suited for use in cutting ductile materials such as metals and brittle materials such as glass, stone and the like.

The second component of the abrasives formulation is a medium-density, medium-hardness cryptocrystalline material which preferably has a cubical form that is retained when the material fractures into smaller particles. Suitable materials include cryptocrystalline copper slag as well as silicate components of copper slag such as fayalite ($Fe_2SiO_4$) and olivine ($(Fe,Mg)SiO_4$). Copper slag is particularly preferred as the second component because it has the desired fracture characteristics and is relatively inexpensive, particularly in comparison to garnet.

The cryptocrystalline copper slag is formed by cooling molten slag at a rate which allows for the formation of small crystals rather than glass or large crystals. Water quenched copper slag should generally be avoided because of the tendency to form a glass rather than crystalline structure. In a presently employed process to obtain cryptocrystalline copper slag, molten slag is dumped onto the ground in a layer approximately 0.5 to 2 inches in thickness and is cooled over the course of 24 hours at ambient temperatures that range between 40° and 120° F. The cooled slag is then placed in a heating chamber and annealed by heating at a temperature of 200° to 300° F. for a period of 5 to 8 minutes. Following removal from the heating chamber, the slag is cooled to approximately 100° F. and is then crushed to the desired particle size.

The second component is generally used in abrasive formulations of the present invention which are intended for use in cutting ductile materials such as metals. It is believed that the second component facilitates the cutting action because the sharp corners of the particles cause the removal of more target material. Notably, because of their cryptocrystalline nature, the second component particles break down into smaller, sharp particles during the formation and travel of the waterjet as well as during impact against the target material. These smaller materials also serve to provide a smoother finish to the cut surface of target material.

Remarkably, the combination of the first and second components, preferably hematite with copper slag, produces an abrasives formulation which is capable of achieving cutting efficiencies in certain hard ductile materials equaling or exceeding those of harder abrasives such as garnet.

The third component of the abrasives formulation comprises a material having a Vickers or Knoop hardness greater than 1500 and is used when the target material being cut or machined is a hard and/or thick metal or a ceramic. Because of the abrasive wear that these ultra-hard abrasives cause on the nozzle mixing tube, it is generally desirable to use only low quantities of the third component in the overall abrasives formulation. It has been found that the use of sufficient amounts of the first and second components relative to the ultrahard third component serve to buffer the abrasive effect of the third component. Examples of materials suitable for use as the third component include one or more minerals selected from the group consisting of diamond, topaz, sapphire, staurolite, corundum, emery and ruby. Examples of suitable synthetic materials include one or more of aluminum oxide, boron carbide and silicon carbide.

A general abrasives formulation of the present invention comprises 30 to 100% of the high-hardness, high-density, crystalline first component, 0 to 70% of the medium-density, medium-hardness, cryptocrystalline second component, and 0 to 40% of the ultra-hard third component. As used herein, all percentages are by weight of the total weight of the abrasives formulation. An example of an abrasives formulation particularly suited for use in cutting brittle materials such as glass and stone comprises 100% of the first component and 0% of the second and third components, with the first component preferably being specular hematite. For cutting hard and/or thick ductile materials, a generally suited abrasives formulation is 25 to 70% of the first component, 15 to 55% of the second component, and 10 to 40% of the third component. Another formulation suited for cutting less hard and/or thick ductile materials contains 20 to 50% of the first component and 50 to 80% of the second component, with the first component preferably comprising specular hematite and the second component preferably comprising copper slag.

The size distribution of the abrasives particles used in the formulations of the present invention can be varied as desired for particular applications. Typically, the particles sizes for the present abrasives will fall within the range from No. 20 U.S. Standard Sieve mesh size down to No. 220 U.S. Standard Sieve mesh size.

In general, the abrasives particle size selection is based in significant part on the intended pressure of the waterjet. To a lesser extent, the particle size selection is based on the desired loading of the abrasives in the waterjet and on the type of target material intended to be cut. Because the larger particles are more effective in removing target material than smaller particles, larger particles are generally preferred for cutting target material while smaller particles are more effective for polishing the cut surface during the cutting process.

In one formulation suitable for low pressure waterjets, i.e. those having pressures within the general range of 10,000 to 30,000 psi, approximately 95 to 100% of the abrasives particles will pass through a No. 18 U.S. Standard Sieve mesh screen and will be retained on a No. 35 U.S. Standard Sieve mesh screen. In another low pressure formulation, approximately 95 to 100% of the particles will pass through a No. 25 U.S. Standard Sieve mesh screen and will be retained on a No. 50 U.S. Standard Sieve mesh screen. For high pressure waterjets having pressures greater than 30,000 psi, one suitable formulation allows approximately 95 to 100% of the particles to pass through a No. 45 U.S. Standard Sieve mesh screen and will be retained on a No. 80 U.S. Standard Sieve mesh screen. In another high pressure formulation, approximately 95 to 100% of the particles will pass through a No. 70 U.S. Standard Sieve mesh screen and will be retained on a No. 170 U.S. Standard Sieve mesh screen. A still further high pressure formulation is one in which approximately 95 to 100% of the particles will pass through a No. 100 U.S. Standard Sieve mesh screen and will be retained on a No. 230 U.S. Standard Sieve mesh screen.

The abrasives can be used to cut or otherwise machine various materials, including metals such as aluminum, steel, titanium and high-nickel alloys, brittle materials such as glass, granite and marble, green and reinforced composite materials, honeycomb and sandwiched materials, and certain ceramics. Remarkably, the combination of the high-hardness, high-density, specular hematite with ambient-cooled, cryptocrystalline copper slag results in a particulate abrasives formulation having a cutting efficiency exceeding that of a harder material such as garnet.

Turning now to FIG. 1, an abrasive waterjet apparatus is shown schematically and is designated generally by the numeral 10. Apparatus 10 is of generally known construction and comprises an abrasive nozzle assembly 12 which is supplied with abrasives from a hopper 14 or other feed system. The abrasives are metered to the nozzle 12 by a valve 16 or other suitable mechanism.

A liquid, typically water, is delivered to the nozzle 12 under pressure. A pump 18 boosts the pressure of water obtained from a suitable source. The pressurized water is then sent through an optional filter 20 such as an ultrafiltration membrane. A high-pressure pump 22 increases the water pressure to the desired value. The high-pressure water is then delivered to an accumulator 24 prior to delivery to the nozzle 12. A suitable valve 26 is used to control delivery of the high-pressure water to the nozzle 12.

Figure 2:
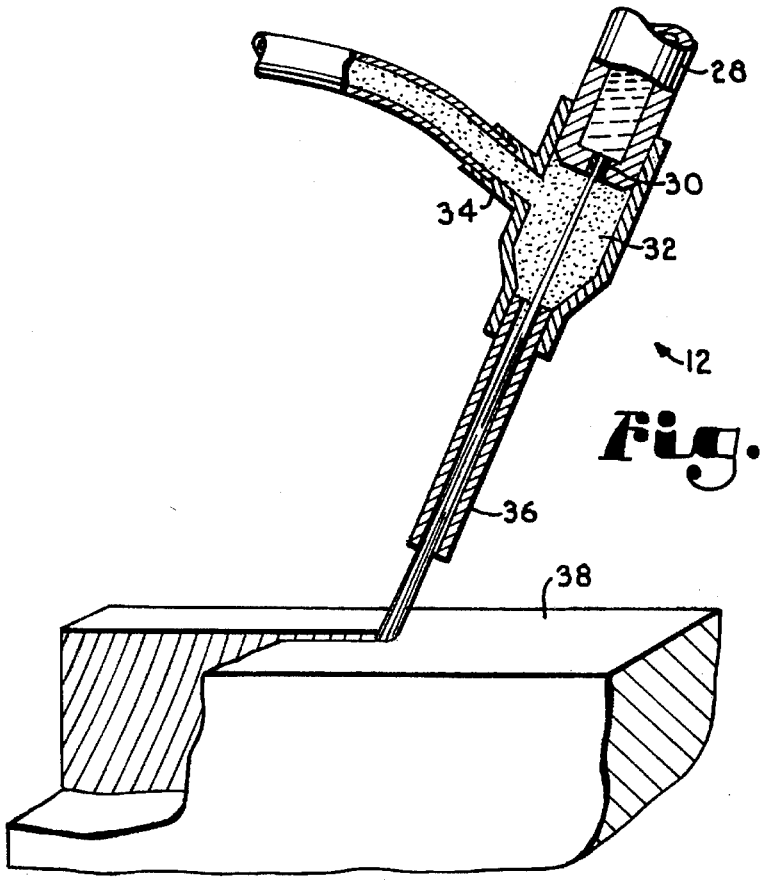
FIG. 2 is a side elevation view of a waterjet nozzle which can be used with the abrasives of the present invention.

Nozzle 12 is shown in greater detail in FIG. 2 and comprises a high-pressure water inlet 28 which leads to an adjustable orifice 30 that forms the waterjet. A mixing chamber 32 is positioned downstream from the orifice 30 in the path of the waterjet. The vacuum created by the waterjet draws abrasives through an inlet 34 into the mixing chamber 32 for mixing with the liquid in the waterjet. The abrasives-laden waterjet is then delivered from nozzle 12 through a mixing and focusing tube 36 and directed onto the target material 38 for the desired machining operation.

A method for machining a target material thus comprises the steps of generating an abrasive waterjet comprising a liquid and entrained abrasives particles of the type previously described and directing the abrasive waterjet against the target material to remove portions thereof.

Notably, because the abrasive formulations of the present invention are generally less hard or have a lower effective hardness than conventional abrasives such as garnet, waterjet nozzles can be utilized which have mixing chambers formed of materials which are less hard and less costly when compared to the ultrahard materials which must be conventionally used to provide a greater wear resistance.

From the foregoing, it will be seen that this invention is one well adapted to attain all the ends and objects hereinabove set forth together with other advantages which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. An abrasives formulation sized for mixing with a fluid to form an abrasive waterjet used to cut target materials, said abrasives formulation comprising a first component comprising particles of a crystalline material selected from one or both of specular hematite and magnetite and having a specific gravity of between approximately 4.5 and 6 with substantially all of the particles being sized to pass through a No. 20 U.S. Standard Sieve mesh screen and be retained on a No. 220 U.S. Standard Sieve screen; and a second component comprising particles of a cyrptocystalline material.

2. The abrasives formulation as set forth in claim 1, comprising 20 to 50% by weight of the crystalline material and 50 to 80% by weight of the cryptocrystalline material, and wherein substantially all of said particles of the cryptocrystalline material will pass through a No. 20 U.S. Standard Sieve mesh screen and will be retained on a No. 220 U.S. Standard Sieve screen.

3. The abrasives formulation as set forth in claim 1, including a third component comprising particles of an ultra-hard material having a Vickers or Knoop hardness of greater than approximately 1500.

4. The abrasives formulation as set forth in claim 3, wherein said particles of the cryptocrystalline material and ultra-hard material have a size distribution wherein substantially all of the particles will pass through a No. 20 U.S. Standard Sieve mesh screen and be retained on a No. 220 U.S. Standard Sieve screen.

5. The abrasives formulation as set forth in claim 4, comprising approximately 25 to 70% by weight of the crystalline material, 15 to 55% by weight of the cryptocrystalline material and 10 to 40% of the ultra-hard material.

6. The abrasives formulation as set forth in claim 5, wherein the crystalline material is specular hematite and the cryptocrystalline material is cryptocrystalline copper slag.

7. The abrasives formulation as set forth in claim 6, wherein the ultra-hard material is selected from the group consisting of one or more of diamond, topaz, sapphire, ruby, aluminum oxide, corundum, staurolite, boron carbide, silicon carbide and emery.

8. An abrasives formulation for mixing with a fluid to form a waterjet used to cut target materials, said abrasives formulation comprising:

a first component comprising particles of a crystalline material having a specific gravity of between approximately 4.5 and 6 and a Vickers or Knoop harness of greater than approximately 900; and a second component comprising particles of a cryptocrystalline material selected from the group consisting of cryptocrystalline copper slag, fayalite and olivine, said particles of the first and second component being sized so that substantially all of the particles will pass through a No. 20 U.S. Standard Sieve mesh screen and be retained on a No. 220 U.S. Standard Sieve screen.

9. The abrasives formulation as set forth in claim 8, wherein said first component comprises specular hematite and said second component comprises cryptocrystalline copper slag.

10. The abrasives formulation as set forth in claim 9, comprising 20 to 50% by weight specular hematite and 50 to 80% by weight cryptocrystalline copper slag.

11. The abrasives formulation as set forth in claim 9, comprising approximately 30% by weight specular hematite and approximately 70% by weight cryptocrystalline copper slag.

12. The abrasives formulation as set forth in claim 9, comprising approximately 25 to 70% by weight of specular hematite, 15 to 55% by weight of cryptocrystalline copper slag and 10 to 40% by weight of one or more of diamond, topaz, sapphire, ruby, aluminum oxide, corundum, staurolite, boron carbide, silicon carbide and emery.

13. An abrasives formulation for mixing with a fluid to form a waterjet used to cut target materials, said abrasives formulation comprising:

25 to 70% by weight specular hematite particles;

15 to 55% by weight cryptocrystalline copper slag particles; and 10 to 40% by weight of a third component comprising particles of an ultra-hard material selected from the group consisting of one or more of diamond, topaz, sapphire, ruby, aluminum oxide, corundum, staurolite, boron carbide, silicon carbide and emery, said particles of the hematite, copper slag and third component having a size distribution wherein substantially all of the particles will pass through a No. 20 U.S. Standard Sieve mesh screen and be retained on a No. 220 U.S. Standard Sieve screen.

14. The abrasives formulation as set forth in claim 13, wherein said third component is aluminum oxide.

15. The abrasives formulation as set forth in claim 14, comprising approximately 25% by weight hematite, 55% by weight copper slag, and 20% by weight aluminum oxide.

16. A method for machining a target material comprising a ductile material, said method comprising the steps of:

generating a waterjet comprising a liquid and entrained abrasives particles, said abrasives particles comprising a crystalline material having a specific gravity of between approximately 4.5 to 6, a Vickers or Knoop hardness of greater than approximately 900, and one or more of cryptocrystalline copper slag, fayalite and olivine; and directing said waterjet against the target material to remove portions thereof.

17. The method as set forth in claim 11, wherein said step of generating a waterjet comprises the step of generating the waterjet comprising the liquid and entrained particles of the crystalline material selected from the group consisting of one or more of specular hematite, magnetite, zircon, rutile, cassiterite, ilmenite, pyrite, and chromite.

18. The method as set forth in claim 16, wherein said step of generating a waterjet comprises the step of generating a waterjet comprising a liquid and entrained particles of the crystalline material comprising one or both of specular hematite and magnetite.

* * * * *

UNITED STATES PATENT AND TRADEMARK OFFICE

CERTIFICATE OF CORRECTION

PATENT NO. : 5,637,030

DATED : June 10, 1997

INVENTOR(S) : Manjit S. Chopra & Stephen F. Mehlman

It is certified that error appears in the above-indentified patent and that said Letters Patent is hereby corrected as shown below:

At column 8, line 54, please delete "11" and insert --16--.

Signed and Sealed this

Twenty-ninth Day of June, 1999

*Attest:*

Q. TODD DICKINSON

*Attesting Officer*

*Acting Commissioner of Patents and Trademarks*